United States Patent [19]

Stove

[11] Patent Number: 4,778,308

[45] Date of Patent: Oct. 18, 1988

[54] ARRANGEMENT IN AN OFFSHORE CONCRETE PLATFORM

[75] Inventor: Olav J. Stove, Lysaker

[73] Assignee: Saga Petroleum A.S., Norway

[21] Appl. No.: 930,309

[22] PCT Filed: Feb. 12, 1986

[86] PCT No.: PCT/NO86/00014

§ 371 Date: Dec. 3, 1986

§ 102(e) Date: Dec. 3, 1986

[87] PCT Pub. No.: WO86/04623

PCT Pub. Date: Aug. 14, 1986

[30] Foreign Application Priority Data

Feb. 12, 1985 [NO] Norway ..... 850517

[51] Int. Cl.[4] ..... E02B 17/02

[52] U.S. Cl. ..... 405/204; 405/203; 405/222; 405/195

[58] Field of Search ..... 405/222, 223, 204, 208, 405/207, 206, 217, 205, 195

[56] References Cited

U.S. PATENT DOCUMENTS

| | | | |
|---|---|---|---|
| 2,912,828 | 11/1959 | Gerwick | 405/222 |
| 3,879,952 | 4/1975 | Mo | 405/207 |
| 4,425,055 | 1/1984 | Tiedemann | 405/204 X |
| 4,497,594 | 2/1985 | Fern | 405/217 |

FOREIGN PATENT DOCUMENTS

| | | | |
|---|---|---|---|
| 1081483 | 7/1980 | Canada | 405/204 |
| 1338500 | 8/1963 | France | 405/207 |
| 2464336 | 4/1981 | France | 405/207 |
| 2021182 | 11/1979 | United Kingdom | 405/204 |
| 2124684 | 2/1984 | United Kingdom | 405/205 |

*Primary Examiner*—Dennis L. Taylor

*Attorney, Agent, or Firm*—Scully, Scott, Murphy & Presser

[57] ABSTRACT

Arrangement in an offshore concrete platform comprising a base structure (1) and at least one tower structure (3) having a tower foot (5). The tower foot (5) is supported by a pair of annular, downwardly diverging, conical shell structures (6,7) forming a transition to the base structure (1). The shell structure (6,7), having angles of inclination which can be varied independently of each other, advantageously may be supported directly by the walls of respective cylinders (11,12) being an integral part of the walls of the base structure (1). The structural shape and geometry of the arrangement implies that the size of the diameter of the tower foot (5) can be chosen independently of the size of the base.

16 Claims, 5 Drawing Sheets

ARRANGEMENT IN AN OFFSHORE CONCRETE PLATFORM

BACKGROUND OF THE INVENTION

The present invention relates to an arrangement in an offshore concrete platform comprising a base structure and at least one tower structure extending upwards from the base and having a tower foot supported by the base.

Normally, the size of the tower foot, i.e. the lower part of a tower on a concrete platform, is fixed and dependent on the size and geometry of the supporting base structure. This locking of the size of the tower foot forms an obstacle to an optimal utilization of the carrying capacity and structural strength of the platform during the various loading phases in the course of the lifetime of the platform. This in turn results in that the platform structure becomes larger and has a larger quantity of concrete than it actually needs to have if it was optimally utilized during the individual loading phases.

SUMMARY OF THE INVENTION

The object of the invention is to provide an arrangement in a concrete platform implying that the size of the diameter of the tower foot can be chosen independently of the size of the base structure, at the same time as a good transfer of forces is secured.

According to the invention, the above object is achieved in a platform of the introductorily stated type in that the tower foot is supported by a pair of annular, essentially concentric, downwards diverging shell structures forming a transition from the tower foot to the base structure.

In an advantageous embodiment of the arrangement, wherein the tower foot has a circular cross-section, the shell structures are frusto-conical and are joined to each other at their upper ends and there have a diameter corresponding to the diameter of the tower foot.

Further, it is advantageous that the shell structures are directly supported by respective cylinders constituting an integral part of the base structure.

The freedom of design which is achieved with the arrangement according to the invention, offers the possibility of an optimalization of the geometry of the entire carrying structure, something which may involve large optimalization profits as far as material quantity and price, building time and functional quality are concerned.

BRIEF DESCRIPTION OF THE DRAWINGS

The invention will be further described below in connection with exemplary embodiments schematically shown in the accompanying drawings, wherein similar reference numerals designate corresponding elements, and wherein.

DETAILED DESCRIPTION OF THE PREFERRED EMBODIMENTS

Figure 1:
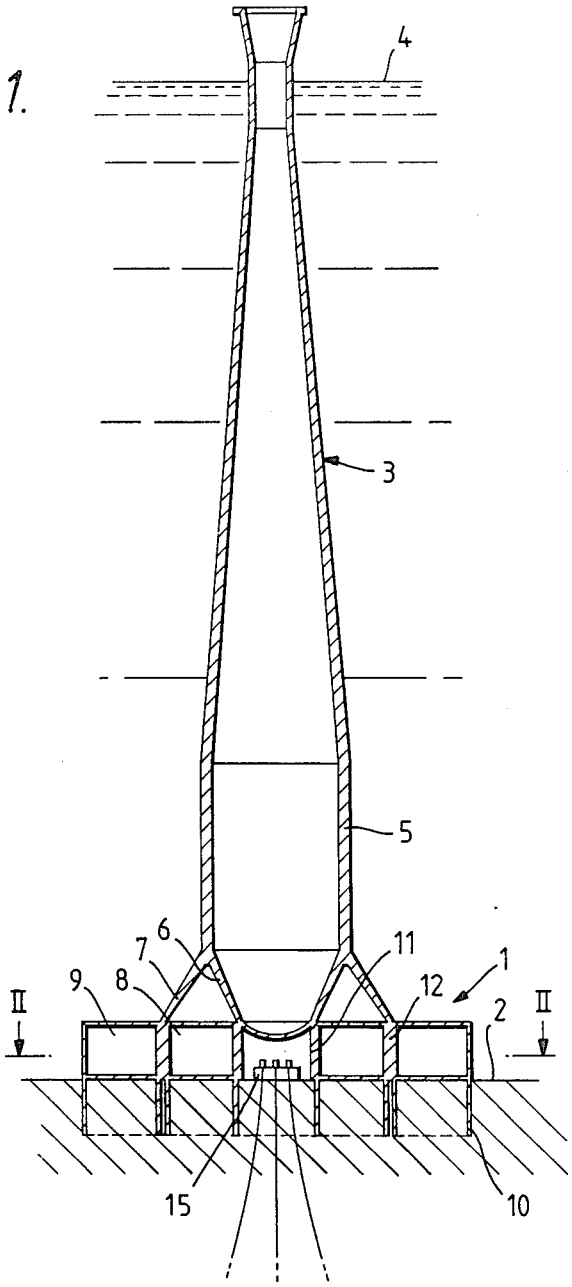
FIG. 1 shows a longitudinal section of a platform wherein the transition between the tower and the base of the platform is designed in accordance with the invention.

The concrete platform illustrated schematically in FIG. 1 is a gravity platform having a base structure 1 resting on a sea bed 2, and a tower structure 3 extending upwards from the base and being intended to project above the water surface 4 to carry a deck structure (not shown). The lower part or foot 5 of the tower structure in the illustrated example is cylindrical and has a circular cross-section. Between the tower foot 5 and the base 1 there is provided, in accordance with the invention, a pair of annular, downwards diverging shell elements 6, 7 forming a transition between the tower and the base. The shell elements 6, 7 are concentric and frusto-conical with oppositely conical extension. Further, in the shown embodiment, the shells are joined to each other at their upper ends and there have a diameter corresponding to the diameter of the tower foot 5, the shells being cast together with the outer wall of the tower foot and form a lower extension thereof.

Figure 2:
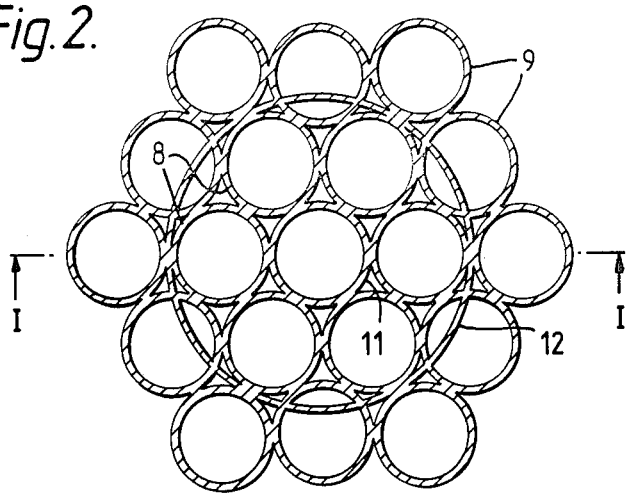
FIG. 2 shows a section along the line II—II in FIG. 1.

The base structure consists of a plurality of short, closed cells which may have a cylindrical cross-section and, for example, be arranged as shown in FIG. 2. The cells are here arranged in an inner circular ring of cells 8 and an outer hexagonal ring of cells 9, wherein mutually adjacent cells contact each other. The base structure has downwards extending skirts 10 penetrating the sea bed 2 and which may be constituted by extensions of the cell walls.

At the top of the base structure 1, each of the shell elements 6, 7 is directly supported by a respective cylinder 11, 12 constituting an integral part of the base structure. Thus, the inner shell element 6 is supported by the upper edge of an inner cylinder 11 which, at its outer side, in tangent to the cells 8 of the inner ring as shown in FIG. 2, the shell element 6 at its lower end having a diameter corresponding to the diameter of this cylinder. The outer shell element 7 is in turn supported by the upper edge of an outer cylinder 12 which, at its inner side, is also tangent to the inner cells 8, and which further alternately intersects and at its outer side contact the cells 9 of the outer ring as shown in FIG. 2.

Advantageously, the shell elements 6, 7 are cast together with the supporting cylinders along the upper edge portions thereof.

As appears from FIG. 1, also the two cylinders 11, 12 are extended downwards, for the formation of skirts 13, 14 penetrating the sea bed.

It will be appreciated that the angles of inclinations of the two diverging shell elements 6, 7 may be varied independently of each other, so that the two supporting cylinders 11, 12 of the base 1 can be placed optimally for various base geometries. At the same time, the size of the tower cross-section or the tower diameter can be freely chosen in relation to the size of the base.

The transition arrangement according to the invention renders it possible that the base structure can be designed in many different ways. For example, the base can be designed especially with a view to the fact that the platform is to be installed above predrilled wells, as suggested in FIG. 1 wherein well heads 15 of predrilled wells are arranged in a central space defined by the inner cylinder 11. The base may also be designed especially with a view to simplifying the installation and connection of mechanical equipment, such as risers, J tubes or the like (not shown).

In FIGS. 3–4 and FIGS. 5–6 there are shown two additional examples of base geometries which may be adapted to and integrated with the two shell-supporting cylinders 11 and 12. The embodiments corrrespond to the embodiment of FIG. 1 as regards the actual transition arrangement between the tower foot and the base structure.

Figure 3:
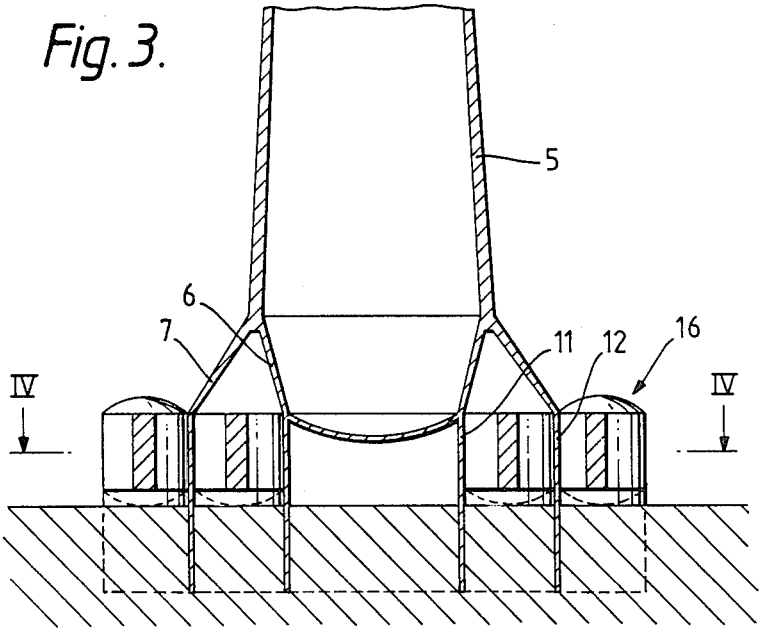
FIG. 3 shows a partial section of a platform wherein the supporting base is modified in relation to the embodiment of FIGS. 1-2.
Figure 4:
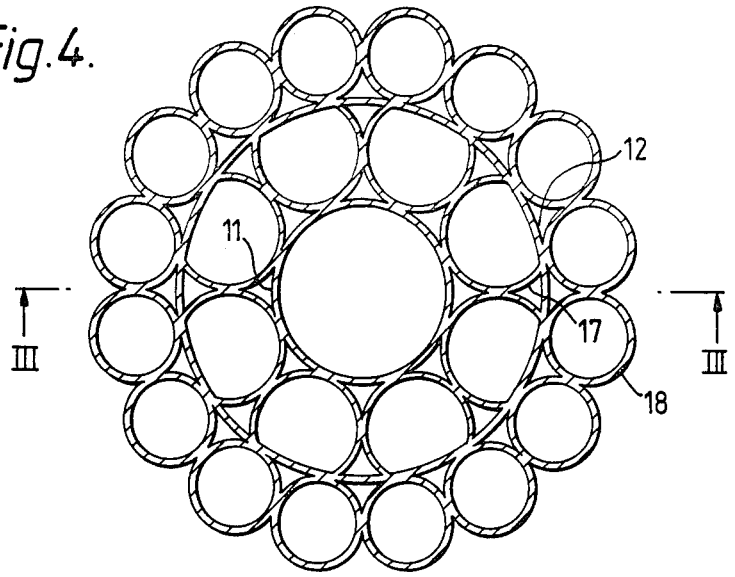
FIG. 4 shows a section along the line IV—IV in FIG. 3.

The base 16 in FIGS. 3–4 includes an inner ring of closed cells 17 and an outer ring of closed cells 18. As shown, the outer side of the inner cylinder 11 is tangent to the inner cells 17, whereas the outer cylinder 12 partly is tangent to the outer cells 18 and partly forms a portion of the vertical wall in each of the inner cells 17.

Figure 5:
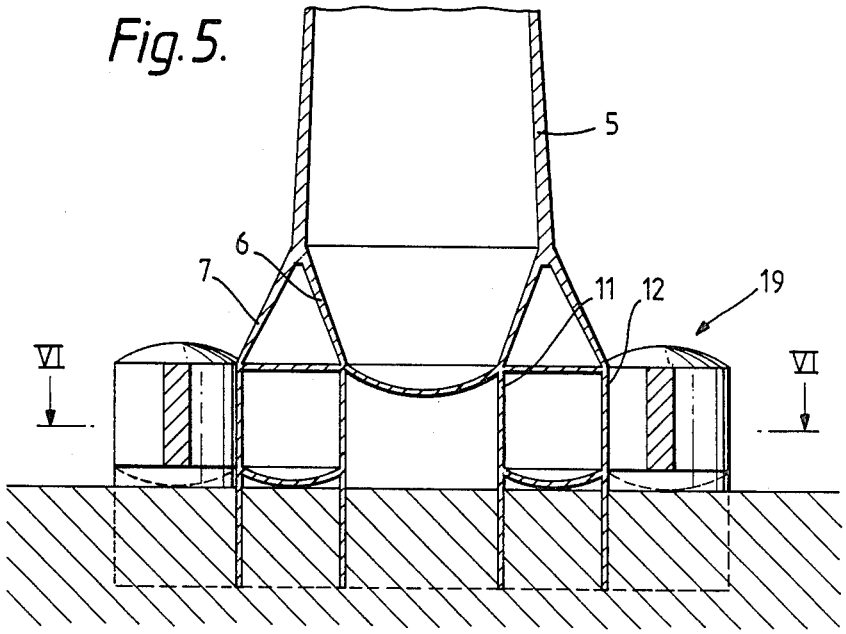
FIG. 5 shows a partial section of a platform having a further modified base.
Figure 6:
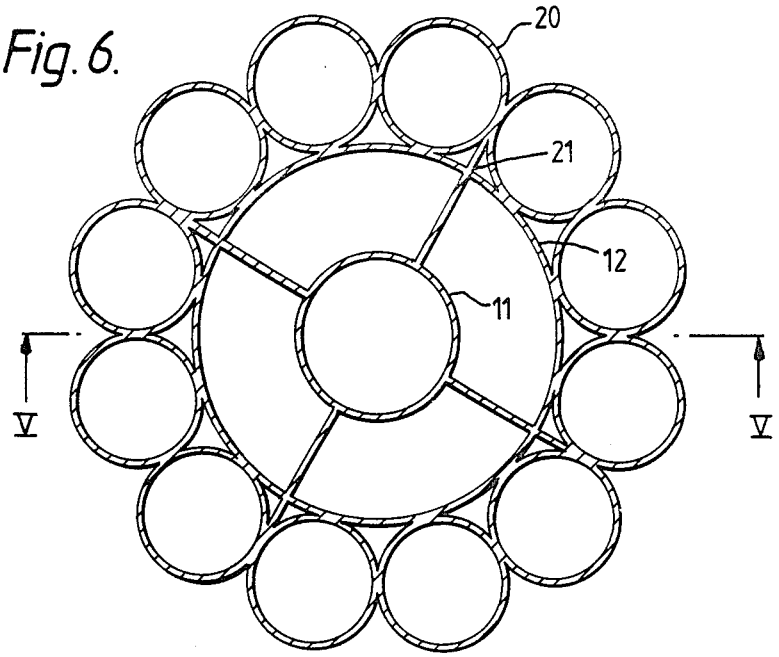
FIG. 6 shows a section along the line VI—VI in FIG. 5.

The base 19 in FIGS. 5–6 includes only one ring of cells 20, and more specifically an externally located ring encircling the outer cylinder 12 so that the outer side thereof is tangent to the cells. The two cylinders 11 and 12 are stiffened in relation to each other by means of four vertical stiffening plates 21 which, at angular intervalls of 90°, extend radially outwards from the inner cylinder 11, through the wall of the outer cylinder 12 and further outwards to the ring of cells 20 wherein each plate is connected with a respective pair of cells along their mutual line of contact.

As appears from the above, the supporting cylinders constitute integral parts of the walls of the various base structures. The arrangement here can be adapted such that the cylinder walls contribute to a suitable dividing of the base structure in compartments for ballast and for production fluid during operation to the platform.

In the foregoing description it is presupposed that the lower portion or foot of the tower structure has a circular cross-section, and that the annular shell elements and the supporting cylinders of the base accordingly also have circular cross-sections. It may be contemplated, however, that the arrangement according to the invention can be adapted in connection with tower structures having another cross-sectional shape, e.g. the shape of a regular polygon.

Figure 8:
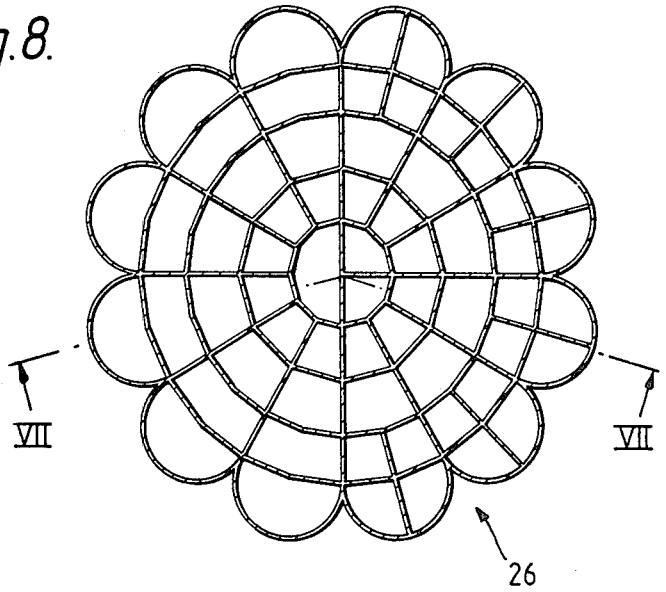
FIG. 8 shows a section along the line VIII—VIII in FIG. 7.
Figure 7:
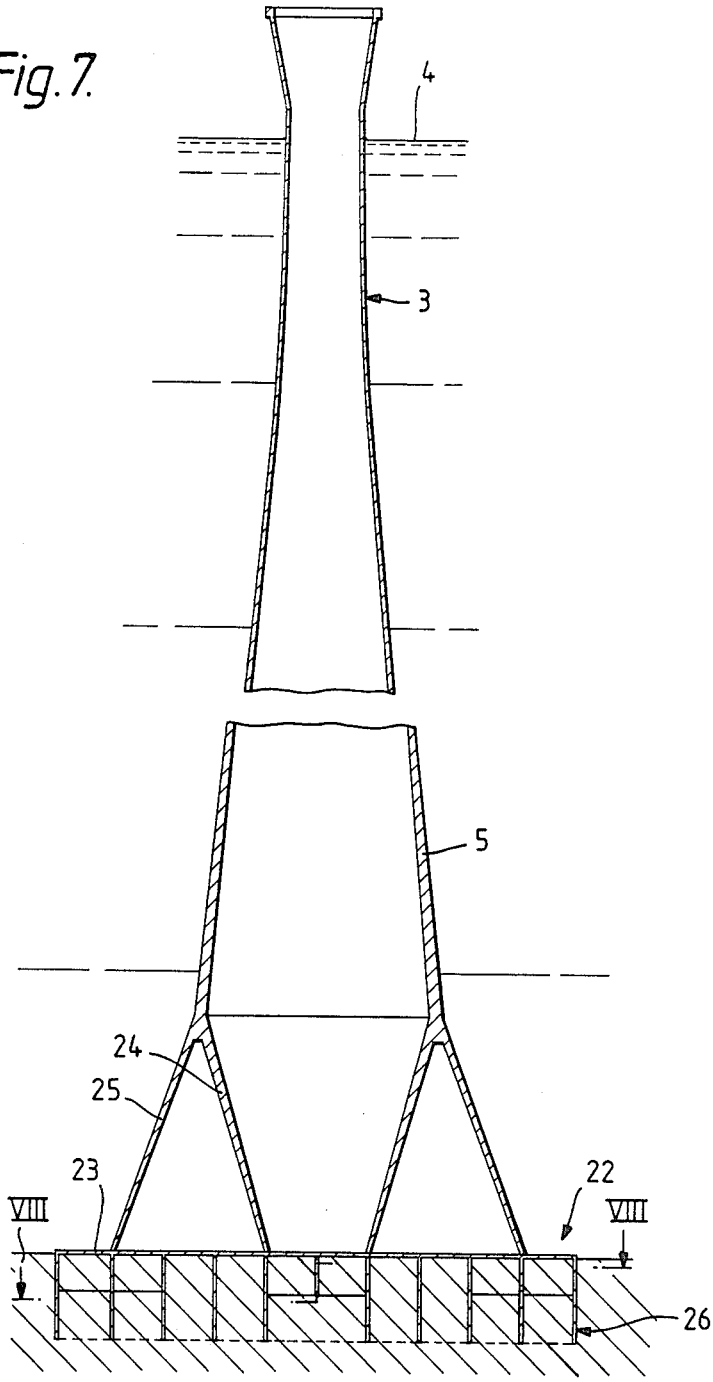
FIG. 7 shows a longitudinal section of a platform wherein the transistion device according to the invention rests directly on a base structure of a type different from that of the embodiment according to FIGS. 1-6.

In FIGS. 7–8 there is shown an additional platform structure having a transition arrangement according to the invention. In this embodiment, the base structure 22 is without closed cells and comprises a base plate 23 supporting the two conical shells 24, 25. A skirt structure 26, which is designed as best shown in FIG. 8, extends downwards from the base plate 23.

In the illustrated and described embodiments, the platforms are shown as a so-called monotower structure. However, the invention may also be adapted and used in connection with platforms consisting of several towers extending upwards from a base, a transition arrangement according to the invention then being able to be used in connection with each individual tower or selected ones of the towers.

I claim:

1. An offshore concrete platform, comprising:

a base structure;

an elongated tower structure supported by the base structure and defining a longitudal axis;

a transition structure located between the tower structure and the base structure and connecting the tower structure thereto, and including inner and outer conical shells, said shells having a common upper edge connected to a bottom edge of the tower structure, each of the shells extending downward to the base structure, the inner shell extending downwardly inwardly from said common edge and toward said longitudal axis, the outer shell extending downwardly outwardly from said common edge and away from said longitudal axis.

2. A platform according to claim 1, wherein:

the tower structure includes a foot portion extending upward from the bottom edge of the tower;

the foot portion has a circular cross-section having a given diameter;

each of the shells has frusto-conical shape and said common edge has a circular shape also having the given diameter.

3. A platform according to claim 1 or to claim 6 wherein:

the base structure includes inside and outside concentric cylinders;

the inner shell is supported by and extends upwards directly from the inside cylinder; and the outer shell is supported by and extends upward directly from the outside cylinder.

4. A platform according to claim 1 or to claim 2, wherein:

the base structure has a flat, base plate; and the inner and outer shells are both supported by and extend upward directly from the base plate.

5. A platform according to claim 2, wherein:

the base structure includes inside and outside, concentric cylinders, the inside cylinder having a first diameter and the outside cylinder having a second diameter;

the inner shell includes a lower edge connected to the inside cylinder;

the lower edge of the inner shell has a circular shape having said first diameter;

the inner shell is concentric with and extends upwards directly from the inside cylinder;

the outer shell includes a lower edge connected to the outside cylinder;

the lower edge of the outer shell has a circular shape having said second diameter; and the outer shell is concentric with and extends upwards directly from the outside cylinder.

6. A platform according to claim 5, wherein each of the inner and outer shells has a linear slope between said common upper edge and the lower edge of the respective shell.

7. A platform according to claim 6, wherein the inner and outer shells and the inside and outside cylinders are all integrally formed together.

8. A platform according to claim 7, wherein the inner and outer shells are free of interconnections between their common upper edge and their respective lower edges.

9. A platform according to claim 7, wherein the base structure further includes an inner ring of cylinders disposed around the outside the inside cylinder, and inside the outside cylinder.

10. A platform according to claim 9, wherein each cylinder of the inner ring of cylinders is tangent both to the inside cylinder and the outside cylinder.

11. A platform according to claim 10, wherein the base structure further includes an outer ring of cylinders extending around the inner ring of cylinders.

12. A platform according to claim 11, wherein each cylinder of the outer ring of cylinders is tangent to at least one cylinder of the inner ring of cylinders.

13. A platform according to claim 12, wherein each cylinder of the inner ring of cylinders is tangent to a pair of adjacent cylinders of said inner ring.

14. A platform according to claim 13, wherein each cylinder of the outer ring of cylinders is tangent to a pair of adjacent cylinders of said outer ring.

15. A platform according to claim 14, wherein the inner and outer rings of cylinders are integrally formed with the inner and outer shells and the inside and outside cylinders.

16. A platform according to claim 15, wherein each cylinder of the inner and outer rings of cylinders has said first diameter.

* * * * *

UNITED STATES PATENT AND TRADEMARK OFFICE

CERTIFICATE OF CORRECTION

PATENT NO. : 4,778,308

DATED : October 18, 1988

INVENTOR(S) : Olav Jan Stove

It is certified that error appears in the above-identified patent and that said Letters Patent is hereby corrected as shown below:

Column 4, Claim 3, line 24: "claim 1 or to claim 6" should read as --claim 1 or to claim 2--

Column 4, Claim 9, line 67: "the outside" should read as --and outside--

Signed and Sealed this

Twenty-eighth Day of March, 1989

*Attest:*

DONALD J. QUIGG

*Attesting Officer*

*Commissioner of Patents and Trademarks*